US006807781B2

(12) United States Patent
Trout

(10) Patent No.: US 6,807,781 B2
(45) Date of Patent: Oct. 26, 2004

(54) BACK BLOCKING DEVICE

(76) Inventor: Darrick S. Trout, 1124 Siddonsburg Rd., Mechanicsburg, PA (US) 17055

( * ) Notice: Subject to any disclaimer, the term of this patent is extended or adjusted under 35 U.S.C. 154(b) by 83 days.

(21) Appl. No.: 10/119,588

(22) Filed: Apr. 10, 2002

(65) Prior Publication Data

US 2003/0192277 A1 Oct. 16, 2003

(51) Int. Cl.[7] ..... E04B 2/00
(52) U.S. Cl. ..... 52/281; 52/731.7
(58) Field of Search ..... 52/222, 281, 417, 52/582.1, 696, 731.7, 731.9, 255

(56) References Cited

U.S. PATENT DOCUMENTS

| | | | | | |
|---|---|---|---|---|---|
| 2,356,309 | A | * | 8/1944 | Garbe | 52/481.2 |
| 2,508,032 | A | * | 5/1950 | Kennedy | 52/731.7 |
| 2,736,929 | A | | 3/1956 | Nies et al. | 20/4 |
| 3,323,264 | A | * | 6/1967 | Cross | 52/281 |
| 3,455,077 | A | | 7/1969 | Long | 52/459 |
| 3,675,383 | A | | 7/1972 | Paoletti | 52/222 |
| 4,028,856 | A | * | 6/1977 | Dalbec | 52/281 |
| 4,237,669 | A | | 12/1980 | Hunter | 52/417 |
| 4,250,676 | A | * | 2/1981 | Presby | 52/222 |
| 4,283,892 | A | * | 8/1981 | Brown | 52/213 |
| 4,392,336 | A | | 7/1983 | Ganssle | 52/417 |
| 4,656,805 | A | * | 4/1987 | Winkowski | 52/417 |
| 4,720,957 | A | * | 1/1988 | Madray | 52/731.7 |
| 4,727,700 | A | | 3/1988 | Eberle | 52/417 |
| 4,763,455 | A | * | 8/1988 | Schneller | 52/255 |
| 4,881,355 | A | * | 11/1989 | Bosl et al. | 52/733.1 |
| 5,349,804 | A | * | 9/1994 | Van Erden et al. | 52/746.11 |
| 5,485,706 | A | * | 1/1996 | Menchetti | 52/731.5 |
| 5,799,458 | A | | 9/1998 | Ferguson | 52/417 |
| 5,832,684 | A | | 11/1998 | Trout et al. | 52/417 |
| 6,108,990 | A | * | 8/2000 | Klamer | 52/281 |

FOREIGN PATENT DOCUMENTS

| | | | | |
|---|---|---|---|---|
| JP | 404146357 | A | * 5/1992 | 52/582.1 |

OTHER PUBLICATIONS

Article entitled "Invisible Drywall Butt Joints" from the *Environmental Building News* magazine dated Nov., 2001.
Article entitled "Get Hip to Butts" by Myron Ferguson from the *Walls & Ceilings* magazine dated Nov., 2001.

* cited by examiner

*Primary Examiner*—Leslie A. Braun
*Assistant Examiner*—Jon A. Szumny
(74) *Attorney, Agent, or Firm*—Barley Snyder

(57) ABSTRACT

A back blocking device comprising an elongated member having a longitudinal axis and a first and second side. The first side of the elongated member has a first outer surface and a second outer surface that converge at the longitudinal axis. The first side has first raised portions and first recessed portions. The second side has a first inner surface and a second inner surface converging at the longitudinal axis, and second raised and recessed portions inverse to the first raised and recessed portions on the first side. First and second pieces of wallboard are positioned on either the first or second raised portions on either the first side or the second side and converge for attachment to the first or second side of the elongated member substantially near the longitudinal axis to form a butt joint.

20 Claims, 9 Drawing Sheets

BACK BLOCKING DEVICE

FIELD OF THE INVENTION

The present invention relates to drywall construction and, more particularly, to an improved back blocking device for providing a smooth flat finished butt joint.

BACKGROUND OF THE INVENTION

In the construction of buildings, interior walls and ceilings typically consist of a layer of gypsum wallboard attached to construction beams made of wood or other materials. The joining of adjacent edges of two pieces of wallboard is accomplished by the application of a plaster-like material to the joint with an embedded layer of paper tape to inhibit cracking of the finished joint. Usually the longer edges of the wallboard are pre-beveled to receive the plaster so that the finished joint is flat and smooth. The ends of the wallboard, however, are not beveled. Additionally, when it is necessary to cut a portion of the wallboard away when fitting it into a smaller space, the pre-beveled edges are frequently removed. In such cases, the finished joint necessarily bulges out of the plane of the wall and is unsightly. An example of such a structure is illustrated in FIG. 1 where the nonbeveled two adjacent edges of two pieces of wallboard 10 and 12 are positioned in alignment with the center of a wooden construction beam 14 and nailed in place with nails 16. Several layers of plaster 18 and an embedded layer of paper tape 20 are applied to the area to form the butt joint. The plaster leaves a bulge 22 that extends away from the plane 24 of the wallboard, as shown. The plaster is feathered outwardly on either side of the joint for about 24 to 36 inches to render the bulge less obvious. This requires a substantial amount of skill and experience and, more importantly, the finished joint is unsightly. This is especially apparent when a glossy finish is applied to the finished surface.

In an effort to overcome this problem, the edges of the two pieces of wallboard to be joined are positioned between two adjacent construction beams. Joint support devices that extend from one construction beam to the other are positioned at intervals along the butt joint and are spaced slightly away from the surface of the wallboard so that when the edges of the wallboard are attached to the support devices, the edges are pulled toward the support device and out of the plane of the wallboard. This provides a recessed area along the joint for receiving the plaster material in a manner similar to that of pre-beveled edges. Examples of such joint support devices are disclosed in U.S. Pat. No. 4,237,669 that issued Dec. 9, 1980 to Hunter and U.S. Pat. No. 4,392,336 that issued Jul. 12, 1983 to Ganssle. Both of these devices have metal structures that extend from one construction beam to the other and are attached to the outwardly facing edges of the beams so that when the wallboard is installed, portions of the support devices are necessarily sandwiched between the mounting surfaces of the beams and the surfaces of the wallboard. These devices cause several problems. First, once the wallboard is held in place preparatory to nailing to the construction beams, the joint support devices are no longer visible, and since they are made of metal, they may interfere when nailing the wallboard to the beams. Further, the portion of the metal structures that are sandwiched between the mounting surfaces of the beams and the wallboard cause bulges in the wallboard and can damage the inner surface of the wallboard if, when nailing, a hammer blow inadvertently strikes the wallboard near an edge of the metal.

Another problem associated with both of these devices is that they are spaced apart a substantial amount so that the two edges of the wallboard are not supported along their entire lengths. This causes the edges of the wallboard to scallop by bowing outwardly in the spaces between the supports, making it more difficult to apply the plaster material and obtain a smooth, flat butt joint. While it is good practice in the industry to glue these butt joint edges to the construction beam for the entire length of the butt joint, this cannot be done in this case. Further, because the joint support devices are made of metal, prior to attaching the edges of the wallboard to the support device, suitable holes must be drilled through the metal to receive the wallboard mounting screws, or self drilling and tapping screws must be used. This, of course, adds to the cost of producing the joint.

Another example of a joint support device is disclosed in French Patent No. 1,287,947. Here, cleats are positioned between two adjacent construction beams and nailed in place. The cleats are spaced part along the site of the butt joint with their wallboard mounting surfaces spaced a slight distance from the wallboard. The two edges of the two pieces of wallboard are then nailed to the cleats causing the edges to bend slightly inwardly out of the plane of the wallboard. Since the cleats are spaced apart a substantial amount so that the two edges of the wallboard are not supported along their entire lengths, as set forth above, the edges of the wallboard will scallop by bowing outwardly in the spaces between the supports, making it more difficult to apply the plaster material and obtain a smooth, flat butt joint. Again, there is no way to glue the edges of the butt joints along their entire lengths. Additionally, the cleats must be accurately cut to fit between the two construction beams, accurately spaced from the wallboard mounting surface, and then securely nailed to the beams, generally requiring the services of a carpenter. This additional work, of course, increases the cost of making the butt joint.

U.S. Pat. No. 5,832,684 issued on Nov. 10, 1998 to Trout et al. discloses a butt joint support device that is easily installed, by the wallboard installer, between two construction beams without cutting to size and which does not require attachment to the beams in any way. The device does not interfere with the normal attachment of the wallboard to the construction beams and provides support to the edges of the two pieces of wallboard. The device has a wallboard mounting surface that is spaced a desired distance from the wallboard to provide the desired beveled effect and requires no drilling of holes during installation of the wallboard. This device, however, is limited in that a completed device can only provide one desired beveled effect. If a beveled effect of a greater angle or smaller angle is desired, the wallboard installer would need to use a separate device manufactured to specifically create the desired beveled effect. Because different types of installation require different beveled effects, more devices are required to be manufactured and stocked. This is both expensive and uneconomical.

It is therefore desirable to develop a rigid back blocking device configured in such a way that it can create more than one beveled effect. A versatile design would decrease manufacturing and storage costs and accommodate varying need.

SUMMARY OF THE INVENTION

This invention relates to a device for use between two construction beams for connecting adjacent ends of a first and second piece of wallboard to form a butt joint. The device comprises an elongated member having a longitudinal axis, a first side and a second side. The first side having a first offset of a first distance. The second side having a second offset opposed to the first offset of a second distance. First and second pieces of wallboard are positioned on either the first side or the second side of the elongated member and converge for attachment to the first or second side of the elongated member substantially near the longitudinal axis to form a butt joint. The elongated member, therefore, can be installed using either the first side or the second side to create a beveled effect of a desired thickness to accommodate varying need.

BRIEF DESCRIPTION OF THE DRAWINGS

The invention will now be described by way of example with reference to the accompanying figures in which.

DETAILED DESCRIPTION OF THE PREFERRED EMBODIMENTS

Figure 1:
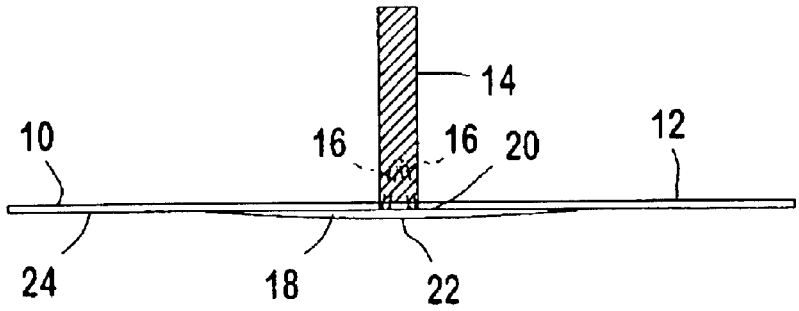
FIG. 1 (PRIOR ART)
FIG. 1 is a cross-sectional view through a construction beam showing a typical prior art joint.
Figure 2:
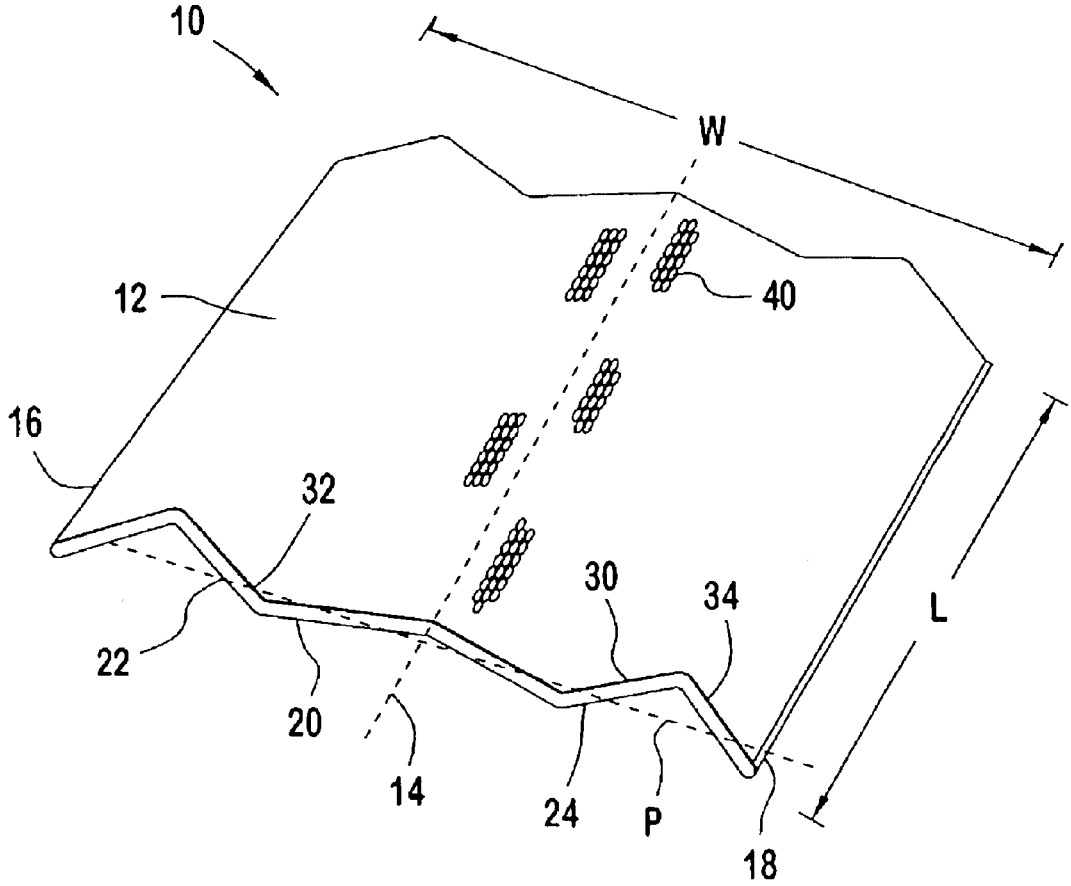
FIG. 2 is an isometric view showing a first embodiment of the back blocking device of a first embodiment of the present invention.

FIG. 2 shows a first embodiment of a back blocking device 10. The back blocking device 10 is an elongated member 12 having a longitudinal axis 14 and a first and second side 20, 30, respectively. The first side 20 having a first outer surface 22 and a second outer surface 24. The second side 30 having a first inner surface 32 and a second inner surface 34. The first outer and inner surfaces 22, 32 extend from a first end 16 of the elongated member 12 to the longitudinal axis 14, and the second outer and inner surfaces 24, 34 extend from a second end 18 of the elongated member 12 to the longitudinal axis 14.

The elongated member 12 is made of 18 to 24 gauge galvanized steel or any other suitable rigid material such as aluminum, or plastic, etc. It will also be appreciated by one skilled in the art that the thickness of the material may be varied depending on the desired dimension of the back blocking device. The length L of the elongated member 12 is preferably longer than the length of the butt joint, and preferably overlaps each end of the butt joint. For example, when the butt joint is 48 inches long, the elongated member 12 should be approximately 54 inches long. It will be appreciated by one skilled in the art, however, that the length L of the elongated member 12 does not have to be longer than the length of the butt joint or has to overlap each end of the butt joint to achieve a similar result. The width W of the elongated member 12 is such that it can be accommodated between two parallel construction beams 11, 15, preferably without causing the first and second ends 16 and 18 to contact the construction beams 11, 15. A plurality of apertures 40, shown in FIG. 2, span the length of the elongated member 12 and are positioned adjacent to the longitudinal axis 14 to form attachment surfaces 26, 28, 36, 38, shown in FIGS. 4 and 5, for attachment of a first and second piece of wallboard 71, 73. The apertures 40 are stamped from the elongated member 12 and sized and shaped for receipt of a standard machine screw, drywall screw, or other fastener. The apertures 40 are arranged so that the fastener may be easily inserted at any given position, simplifying attachment of the wallboard 71, 73 to the elongated member 12.

Figure 3:
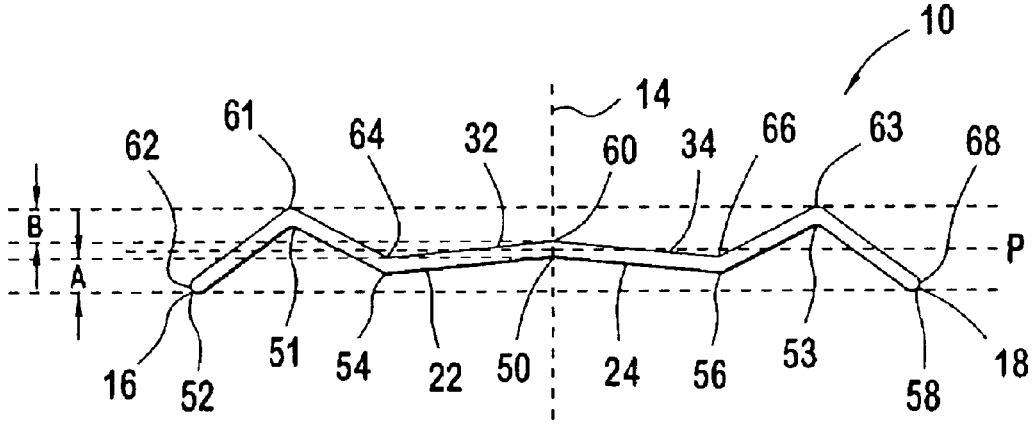
FIG. 3 is a top view of the back blocking device of FIG. 2.

As shown in FIGS. 2 and 3, the elongated member lies in plane P. The first outer surface 22 of the elongated member 12 is bent or molded to have raised portions 52, 54 and recessed portions 50, 51 therebetween. The recessed portions 50, 51 are positioned toward the second side 30 of the plane P of the elongated member 12, and the raised portions 52, 54 are positioned toward the first side 20 of the plane P of the elongated member 12. Moving from the first end 16 of the elongated member 12 toward the longitudinal axis 14, the first end 16 of the elongated member 12 is positioned toward the first side 20 so that the first end 16 creates the first raised portion 52. The elongated member is then formed to create the first recessed portion 51 by bending or molding the elongated member 12 toward the second side 30. The first recessed portion 51 is followed by the second raised portion 54. The first recessed portion 51 forms an angle between the first and second raised portions 52, 54. The first raised portion 52 is positioned at a distance greater from the plane P than the second raised portion 54. A central recessed portion 50 centered at the longitudinal axis 14 is then formed by converging the first outer surface 22 with the second outer surface 24 at a position toward the second side 30 of plane P. The first recessed portion 51 is positioned at a distance greater from the plane P than the central recessed portion 50.

The second outer surface 24 substantially replicates the geometry of the first outer surface 22, as shown in FIG. 3. Moving from the second end 18 of the elongated member 12 toward the longitudinal axis 14, the second end 18 of the elongated member 12 is positioned toward the first side 20 so that the second end 18 creates a first raised portion 58. The elongated member is then formed to create a first recessed portion 53 by bending or molding the elongated member 12 toward the second side 30. The first recessed portion 53 is followed by a second raised portion 56. The first recessed portion 53 forms an angle between the first and second raised portions 58, 56. The first raised portion 58 is positioned at a distance greater from the plane P than the second raised portion 56. A central recessed portion 50 centered at the longitudinal axis 14 is then formed by converging the first outer surface 22 with the second outer surface 24 at a position toward the second side 30 of plane P. The first recessed portion 53 is positioned at a distance greater from the plane P than the central recessed portion 50. The distance A, shown in FIG. 3 by the dashed lines, between the second recessed portion 50 at the longitudinal axis 14 and the first raised portions 52, 58 is approximately 3/16 of an inch. It will be appreciated by one skilled in the art, however, that by varying the height and/or location of the raised portions 52, 54, 58, 56 and/or the depth and/or location of the recessed portions 51, 50, 53 the distance A may be increased or decreased accordingly. It will also be appreciated by one skilled in the art that the distance A could also be accomplished by modifying the height and location of the raised portions 52, 54, 58, 56 and/or the depth and location of the recessed portions 51, 50, 53. Further, one skilled in the art will appreciate that to achieve an offset of a desired dimension, a thicker elongated member 12 would require a smaller offset than a thinner elongated member 12 to achieve substantially the same result.

As a result of the formation of the first side 20 of the elongated member 12, the second side 30 is now contoured to have recessed portions 64, 66 and raised portions 60, 61, 63 inverse to the recessed portions 50, 51, 53 and raised portions 52, 54, 56, 58 on the first side 20. On the second side 30, the first raised portions 61, 63 are positioned farther from the plane P than the central raised portion 60 at the longitudinal axis 14. The recessed portions 64, 66 lie between the central raised portion 60 and first raised portions 61, 63. The distance B, shown in FIG. 3 by the dashed lines, between the central raised portion 60 at the longitudinal axis 14 and the first raised portions 61, 66 is approximately 1/16 of an inch. It will be appreciated by one skilled in the art, however, that by varying the height and/or location of the raised portions 52, 54, 58, 56 on the first side 20 and/or the depth and/or location of the recessed portions 51, 50, 53 on the first side 20 the distance B may be increased or decreased resultantly. It will also be appreciated by one skilled in the art that the distance B could also be accomplished by modifying the height and location of the raised portions 52, 54, 58, 56 and/or the depth and location of the recessed portions 51, 50, 53. Further, one skilled in the art will appreciate that to achieve an offset of a desired dimension, a thicker elongated member 12 would require a smaller offset than a thinner elongated member 12 to achieve substantially the same result.

Figure 4:
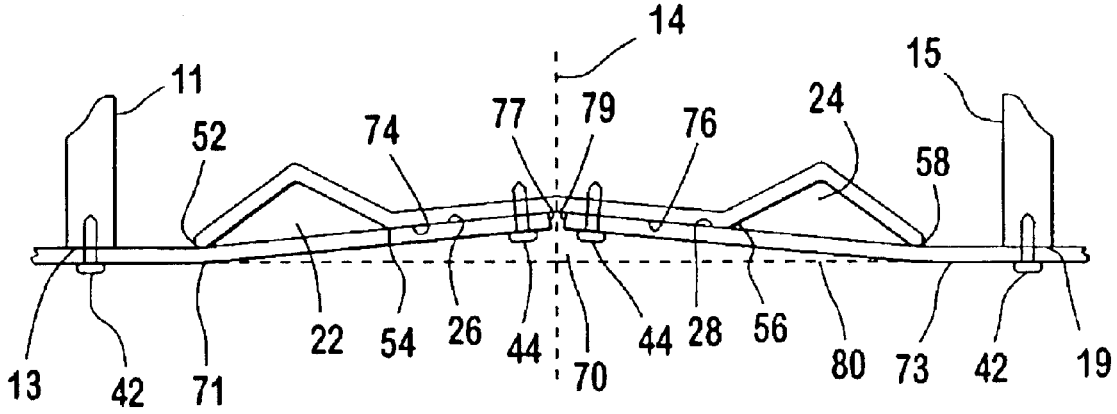
FIG. 4 is a cross-sectional view of the back blocking device of FIG. 2 after it has been installed to create a beveled effect using a first side of the back blocking device.

The installation of the back blocking device 10 will now be described with reference to FIG. 4. To create a beveled effect using the first side 20 of the elongated member 12, the back blocking device 10 is inserted between the two construction beams 11 and 15 such that the first side 20 of the elongated member 12 faces outward. The contour of the elongated member 12 to have raised portions 52, 54, 56, 58 and recessed portions 50, 51, 53 provides rigidity in the length of the elongated member 12 and allows an assembler to easily grip the back blocking device 10 during assembly. A first piece of wallboard 71, having a first interior surface 74, is positioned over the first outer surface 22 of the elongated member 12 with its butt end 77 approximately centered between the two construction beams 11 and 15. One skilled in the art will appreciate, however, that the butt end 77 need not be centered between the two construction beams 11 and 15. The first piece of wallboard 71 is attached to an end surface 13 of the construction beam 11, by means of a fastener such as a nail 42, screw, etc. The back blocking device 10 is then positioned so that the first interior surface 74 of the first wallboard 71 is positioned adjacent to the first raised portion 52 and the second raised portion 54 of the first outer surface 22, and the longitudinal axis 14 is closely adjacent the butt end 77. The first interior surface 74 of the first wallboard 71 is then attached to the first outer attachment surface 26 by means of a standard machine screw 44, or other known fastening means, inserted into a corresponding aperture 40.

A second piece of wallboard 73 is then attached in a similar manner to the second outer surface 24 of the first side 20. The second piece of wallboard 73, having a second interior surface 76, is positioned with its butt end 79 approximately centered between the two construction beams 11 and 15. One skilled in the art will appreciate, however, that the butt end 79 need not be centered between the two construction beams 11 and 15. The second piece of wallboard is attached to an end surface 19 of the construction beam 15 by means of a fastener such as the nail 42, so that its butt end 79 is adjacent to the butt end 77. The second interior surface 76 of the second wallboard 73 is then positioned adjacent to the first raised portion 58 and the second raised portion 56 of the second outer surface 24, and the longitudinal axis 14 is closely adjacent the butt end 79. The second interior surface 76 of the second wallboard 73 is attached to the second outer attachment surface 28 by means of a standard machine screw 44, or other known fastening means, inserted into a corresponding aperture 40. Attachment of the first and second pieces of wallboard 71 and 73 to the first side 20 of the elongated member 12 pulls the two butt ends 77 and 79 of the two pieces of wallboard 71 and 73 away from the normal plane 80 of the drywall surface, shown in FIG. 4 by dashed lines, thereby forming a depression 70. The depression 70 can then be filled with plaster and a layer of embedded paper tape, in the usual manner, to complete the butt joint and form a smooth, flat joint.

Figure 5:
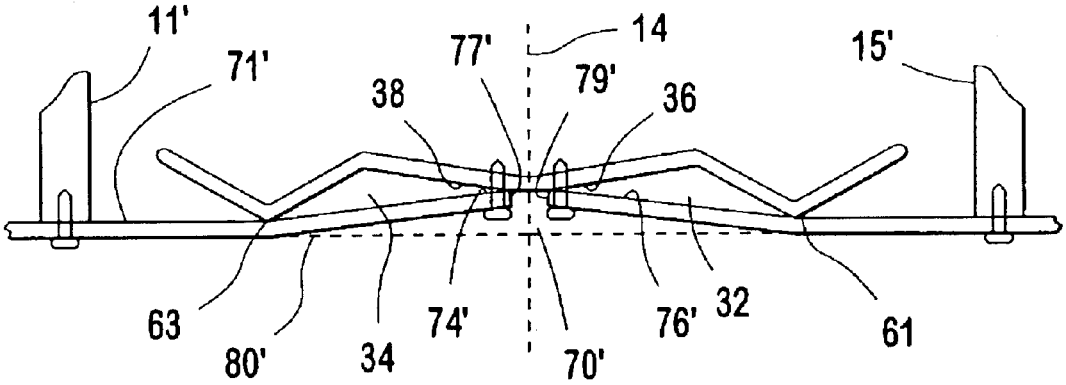
FIG. 5 is a cross-sectional view of the back blocking device of FIG. 2 after it has been installed to create a beveled effect using a second side of the back blocking device.

The elongated member 12 can be installed using the second side 30 to create a beveled effect of a different thickness. Because the elongated member 12 accommodates two different thicknesses of wallboard, approximately 3/8 inches to 1/2 inches and 1/2 inches to 5/8 inches, the butt joint hangar 10 reduces manufacturing and storage costs as well as expedites installation. The installation of the back blocking device 10 to create a beveled effect using the second side 30 of the elongated member 12 is accomplished in substantially the same way, as shown in FIG. 5. The back blocking device 10 is inserted between the two construction beams 11' and 15' such that the second side 30 faces outward. The contour of the elongated member 12 to have raised portions 61, 63, 60 and recessed portions 64, 66 provides rigidity in the length of the elongated member 12 and allows the assembler to easily grip the back blocking device 10 during assembly. In this configuration, however, the back blocking device 10 is positioned so that the first interior surface 74' of the first wallboard 71' is positioned adjacent to the raised portion 63 of the second inner surface 34, and the first interior surface 74' is attached to the second inner attachment surface 38. The second interior surface 76' of the second wallboard 73' is positioned adjacent to the raised portion 61 of the first inner surface 32, and the first interior surface 74' is attached to the first inner attachment surface 36. Attachment of the first and second pieces of wallboard 71' and 73' to the second side 30 of the elongated member 12 pulls the two butt ends 77' and 79' of the two pieces of wallboard 71' and 73' away from the normal plane 80' of the drywall surface, shown in FIG. 5 by dashed lines, thereby forming a depression 70' greater than the depression 70 formed in FIG. 4. The depression 70' can then be filled with plaster and a layer of embedded paper tape, in the usual manner, to complete the butt joint and form a smooth, flat joint.

One skilled in the art may appreciate that the back blocking device 10 of the present invention may be altered geometrically to obtain the same results. By altering the configuration of the elongated member 12, the back blocking device 10 may still have the same or equivalent properties as the first embodiment. Several variations of the first embodiment of the back blocking device 10 of the present invention will be discussed below.

Figure 6:
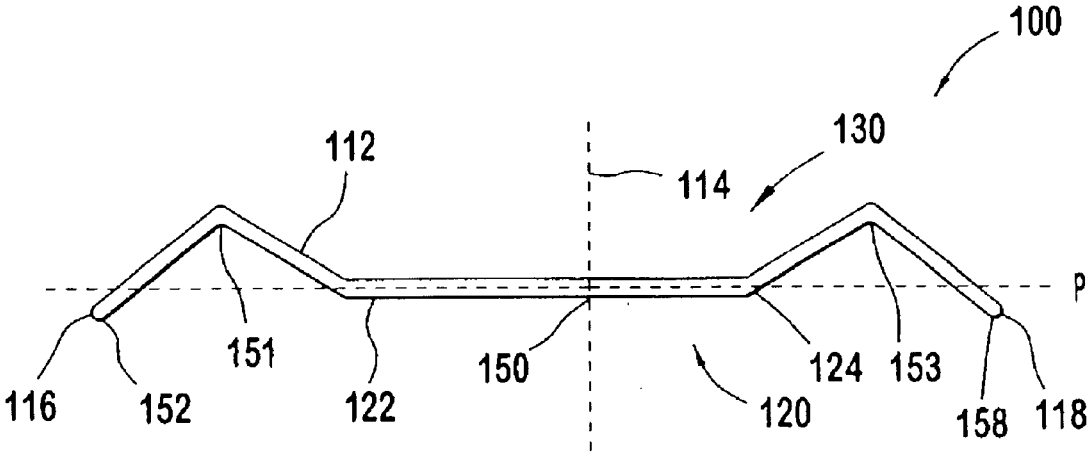
FIG. 6 is a top view of a first variation of the first embodiment of the back blocking device of the present invention.

A first variation of the first embodiment of the back blocking device 10 is shown in FIG. 6 and identified as back blocking device 100. Butt joint hangar 100 has an elongated member 112 lying in a plane P having a length and thickness similar to that of the elongated member 12. The elongated member 112 has a first side 120 and a second side 130. In this variation, the elongated member 112 has a first end 116 and a second end 118 configured in substantially the same manner as the first side 20 of elongated member 12. Moving from the first end 116 toward the longitudinal axis 114 along a first outer surface 122 of the first side 120, the first end 116 creates a first raised portion 152, followed by a first recessed portion 151. The first recessed portion 151 is followed by a substantially flat portion 150 positioned along the plane P. Moving from the second end 118 toward the longitudinal axis 114 along a second outer surface 124, the second end 118 creates a first raised portion 158, followed by a first recessed portion 153. The first recessed portion 158 is followed by a substantially flat portion 150 positioned along the plane P. The back blocking device 100, therefore, has a substantially flat portion 150 in plane P at the longitudinal axis 114 where the first outer surface 122 and the second outer surface 124 converge. The back blocking device 100 is installed and will function in a manner similar to that of the back blocking device 10, described above, wherein both the first side 120 and the second side 130 accommodate different wallboard thicknesses to create a desired beveled effect.

Figure 7:
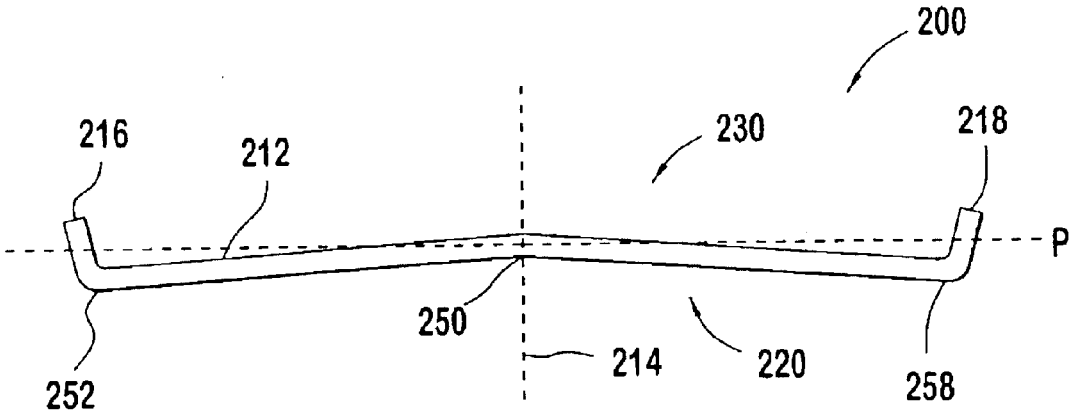
FIG. 7 is a top view of a second variation of the first embodiment of the back blocking device of the present invention.

A second variation of the first embodiment of the back blocking device 10 is shown in FIG. 7 and identified as back blocking device 200. Butt joint hangar 200 has an elongated member 212 lying in a plane P having a length and thickness similar to that of the elongated member 12. The elongated member 212 has a first side 220 and a second side 230. In this variation, the elongated member 212 has a first end 216 and a second end 218 positioned toward the second side 230 of the plane P. First raised portions 252, 258 are positioned toward the first side 220 of plane P substantially near the first end 216 and second end 218, respectively. Moving from the raised portions 252, 258 toward the longitudinal axis 214, a first outer surface 222 and a second outer surface 232 converge at the longitudinal axis 214 and form a recessed portion at the longitudinal axis 214 toward the second side of plane P. The back blocking device 200 is installed and will function in a manner similar to that of the back blocking device 10 described above wherein both the first side 220 and the second side 230 accommodate different wallboard thicknesses to create a desired beveled effect.

Figure 8:
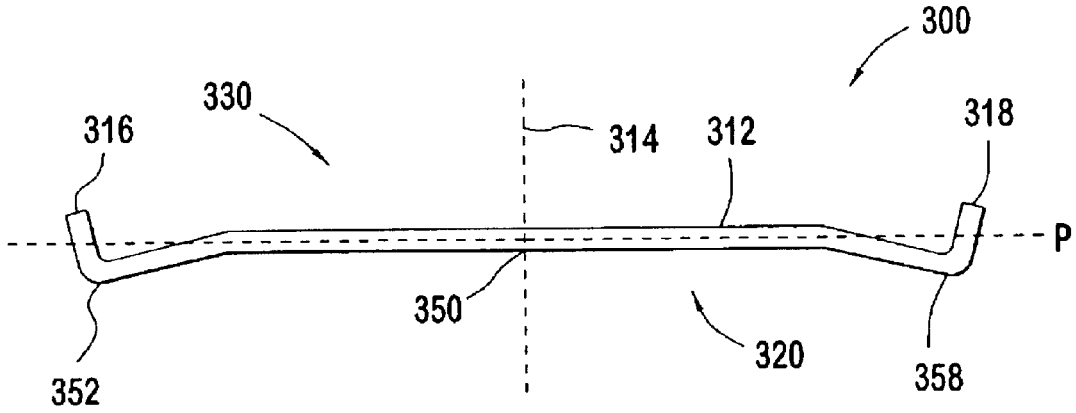
FIG. 8 is a top view of a third variation of the first embodiment of the back blocking device of the present invention.

A third variation of the first embodiment of the back blocking device 10 is shown in FIG. 8 and identified as back blocking device 300. Back blocking device 300 has an elongated member 312 lying in a plane P having a length and thickness similar to that of the elongated member 12. The elongated member 312 has a first side 320 and a second side 330. In this variation, the elongated member 312 has a first end 316 and a second end 318 positioned toward the second side 330 of the plane P. First raised portions 352, 358 are positioned toward the first side 320 of plane P substantially near the first end 316 and second end 318, respectively. Moving from the raised portions 352, 358 toward the longitudinal axis 314, a first outer surface 322 and a second outer surface 332 form a substantially flat portion 350 at the longitudinal axis 314 in the plane P. The back blocking device 300 is installed and will function in a manner similar to that of the back blocking device 10 described above wherein both the first side 320 and the second side 330 accommodate different wallboard thicknesses to create a desired beveled effect.

Figure 9:
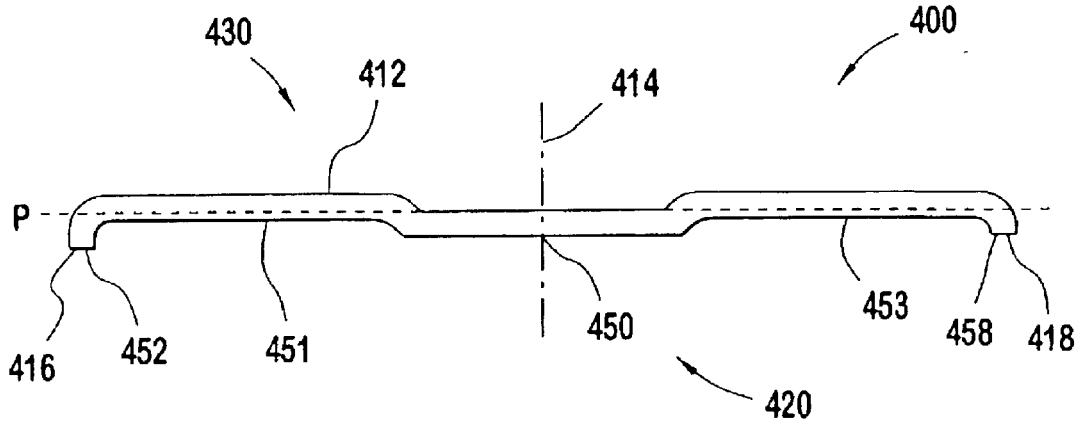
FIG. 9 is a top view of a fourth variation of the first embodiment of the back blocking device of the present invention.

A fourth variation of the first embodiment of the back blocking device 10 is shown in FIG. 9 and identified as back blocking device 400. Back blocking device 400 has an elongated member 412 lying in a plane P having a length and thickness similar to that of the elongated member 12. The elongated member 412 has a first side 420 and a second side 430. In this variation, the elongated member 412 has a first end 416 and a second end 418 positioned toward the first side 420 of the plane P to create first raised portions 452, 458 substantially perpendicular to the plane P. Moving from the raised portions 452, 458 toward the longitudinal axis 414, first recessed portions 451, 453 are positioned toward the second side 430 of the plane P and form substantially flat first recessed portions 451, 453 that extend substantially near the longitudinal axis 414. Moving from the first recessed portion 451 on a first outer surface 422 and the second recessed portion 453 on a second outer surface 432 toward the longitudinal axis 414, the first outer surface 422 and the second outer surface 432 converge to form a substantially flat portion 450 at the longitudinal axis 414 in the plane P. The back blocking device 400 is installed and will function in a manner similar to that of the back blocking device 10 described above wherein both the first side 420 and the second side 430 accommodate different wallboard thicknesses to create a desired beveled effect.

Figure 10:
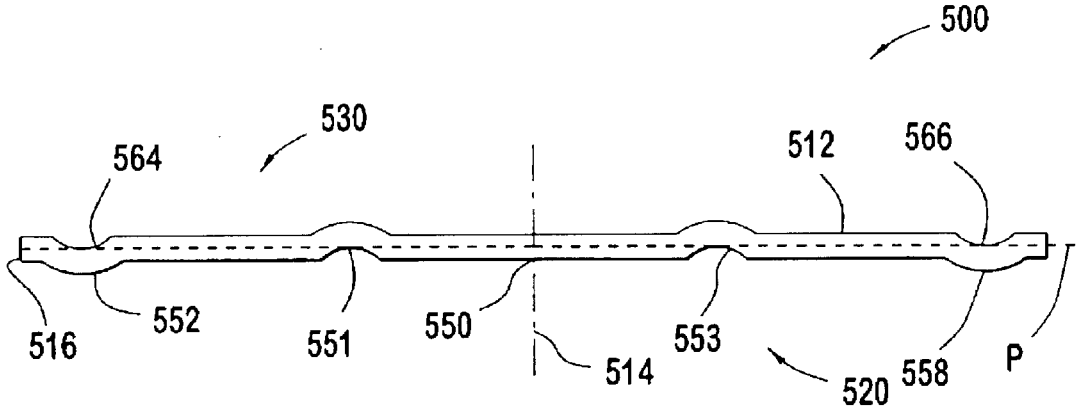
FIG. 10 is a top view of a fifth variation of the first embodiment of the back blocking device of the present invention.

A fifth variation of the first embodiment of the back blocking device 10 is shown in FIG. 10 and identified as back blocking device 500. Back blocking device 500 has an elongated member 512 lying in a plane P having a length and thickness similar to that of the elongated member 12. The elongated member 512 has a first side 520 and a second side 530. In this variation, the elongated member 512 has a first end 516 and a second end 518 lying in the plane P. First raised portions 552, 558 are positioned substantially near the first and second ends 546, 518, respectively, and toward the first side 520 of the plane P. The first raised portions 552, 558 are convex creating first concave recessed portions 564, 566 inverse to the raised portions 552, 558 on the second side 530 of the elongated member 512. Moving from the raised portions 552, 558 toward the longitudinal axis 514, first recessed portions 551, 553 are positioned near the longitudinal axis 514. The first recessed portions 551, 553 are concave in shape and are positioned toward the second side 530 of the plane P. Moving from the first recessed portion 551 on a first outer surface 522 and the second recessed portion 553 on a second outer surface 532 toward the longitudinal axis 514, the first outer surface 522 and the second outer surface 532 converge to form a substantially flat portion 550 at the longitudinal axis 514 in the plane P. The back blocking device 500 is installed and will function in a manner similar to that of the back blocking device 10 described above wherein both the first side 520 and the second side 530 accommodate different wallboard thicknesses to create a desired beveled effect.

Figure 11:
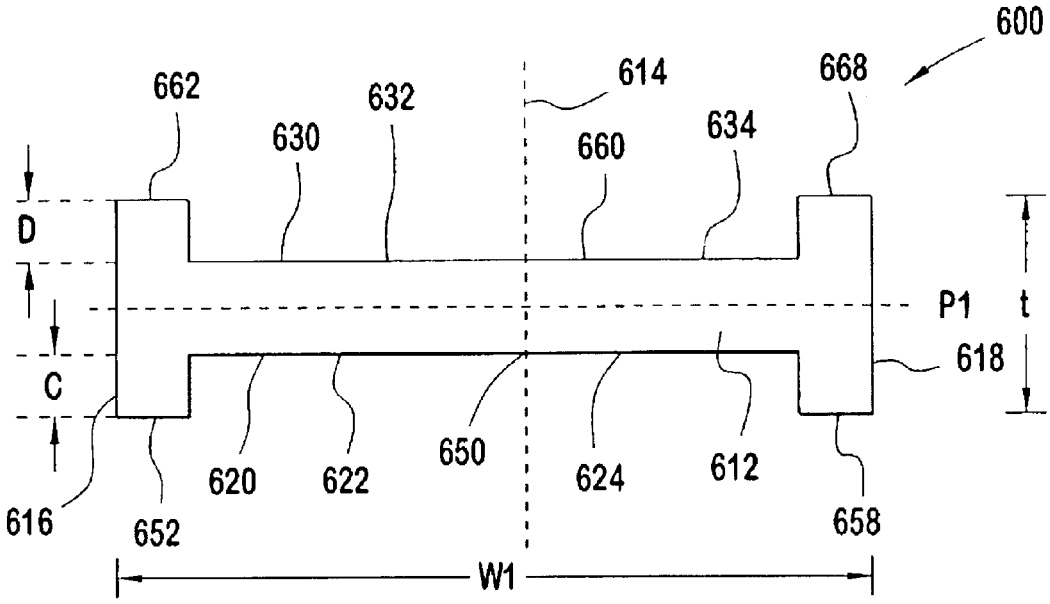
FIG. 11 is a top view of a second embodiment of the back blocking device of the present invention.

A second embodiment of the back blocking device 10 is shown in FIG. 11 and identified as back blocking device 600. The second embodiment of the back blocking device 10 has several different characteristics than the first embodiment, however, the second embodiment functions in a substantially similar manner and achieves substantially similar results as the first embodiment. The back blocking device 600 has an elongated member 612 lying in a plane P1 and having a longitudinal axis 614, a first side 620, a second side 630, and first and second ends 616, 618, respectively. The first side 620 having a first outer surface 622 and a second outer surface 624. The second side 630 having a first inner surface 632 and a second inner surface 634. The first outer and inner surfaces 622, 632 extend from the first end 616 to the longitudinal axis 614, and the second outer and inner surfaces 624, 634 extend from the second end 618 to the longitudinal axis 614.

The elongated member 612 is made of a material such as wood or plastic and has a width W1 of approximately 4 inches, a thickness t of approximately ¾ inches, and a length similar to the elongated member 12 of the first embodiment 10. The elongated member 612 is molded or extruded to have a plurality of raised portions 652, 658, 662, 668 that function in a substantially similar manner as the raised portions 52, 58, 62, 68 of the first embodiment. A plurality of apertures (not shown) span the length of the elongated member 612 and are positioned adjacent to the longitudinal axis 614 on the first and second sides 620, 630 for attachment of first and second pieces of wallboard (not shown). The apertures (not shown) function in a substantially similar manner as the apertures 40 of the first embodiment.

The first side 620 of the elongated member 612 will now be described in greater detail. Moving from the first end 616 toward the longitudinal axis 614 along the first outer surface 622 of the first side 620, the first end 616 has a raised portion 652. The raised portion 652 extends away from the plane P1 toward the first side 620. The raised portion 652 is substantially perpendicular to the plane P1. Moving from the raised portion 652 toward the longitudinal axis 614, the first side has a substantially flat portion 650 substantially parallel to the plane P1. Moving from the second end 618 toward the longitudinal axis 614 along the second outer surface 624 of the first side 620, the second end 618 has a raised portion 658. The raised portion 658 extends away from the plane P1 toward the first side 620. The raised portion 658 is substantially perpendicular to the plane P1. Moving from the raised portion 658 toward the longitudinal axis 614, the first side has a substantially flat portion 650 parallel to the plane P1. The substantially flat portion 650 extends from the raised portion 652 through the longitudinal axis 612 and to the raised portion 658. The raised portions 652, 658 extend substantially the same distance from the plane P1. The distance C from the raised portions 652, 658 to the flat portion 650 at the longitudinal axis 612 is approximately 1/16 of an inch. It will be appreciated by one skilled in the art, however, that by varying the height and/or location of the raised portions 652, 658 the distance C may be increased or decreased accordingly. It will also be appreciated by one skilled in the art that the distance C could also be accomplished by modifying the height and location of the raised portions 652, 658.

The second side 630 of the elongated member 612 will now be described in greater detail. Moving from the first end 616 toward the longitudinal axis 614 along the first inner surface 632 of the second side 630, the first end 616 has a raised portion 662. The raised portion 662 extends away from the plane P1 toward the second side 630. The raised portion 662 is substantially perpendicular to the plane P1 and is substantially opposite from the raised portion 652 on the first side 620. Moving from the raised portion 662 toward the longitudinal axis 614, the second side 630 has a substantially flat portion 660 parallel to the plane P1. Moving from the second end 618 toward the longitudinal axis 614 along the second inner surface 634 of the second side 630, the second end 618 has a raised portion 668. The raised portion 668 extends away from the plane P1 toward the second side 630. The raised portion 668 is substantially perpendicular to the plane P1 and is substantially opposite from the raised portion 658 on the first side 620. Moving from the raised portion 668 toward the longitudinal axis 614, the second side 630 has a substantially flat portion 660 parallel to the plane P1. The substantially flat portion 660 extends from the raised portion 662 through the longitudinal axis 612 and to the raised portion 668. The raised portions 662, 668 extend substantially the same distance from the plane P1. The distance D from the raised portions 662, 668 to the flat portion 660 at the longitudinal axis 612 is approximately 3/16 of an inch. One skilled in the art will appreciate, however, that by varying the height and/or location of the raised portions 662, 668 the distance D may be increased or decreased accordingly. It will also be appreciated by one skilled in the art that the distance D could also be accomplished by modifying the height and location of the raised portions 662, 668. Further, although the preferred second embodiment has the raised portions 652, 658 on the first side 620 positioned directly opposite from the raised portions 662, 668 on the second side 630, it is not necessary that the raised portions 652, 658 on the first side 620 and the raised portions 662, 668 on the second side 630 are positioned directly opposite to each other in order to achieve a substantially similar result.

Back blocking device 600 is installed and will function in a manner similar to that of the back blocking device 10 of the first embodiment described above wherein both the first side 620 and the second side 630 accommodate different wallboard thicknesses to create a desired beveled effect.

One skilled in the art may appreciate that the back blocking device 600 of the present invention may be altered geometrically to obtain the same results. By altering the configuration of the elongated member 612, the back blocking device 600 may still have the same or equivalent properties as the second embodiment. Several variations of the second embodiment of the back blocking device 600 of the present invention will be discussed below.

Figure 12:
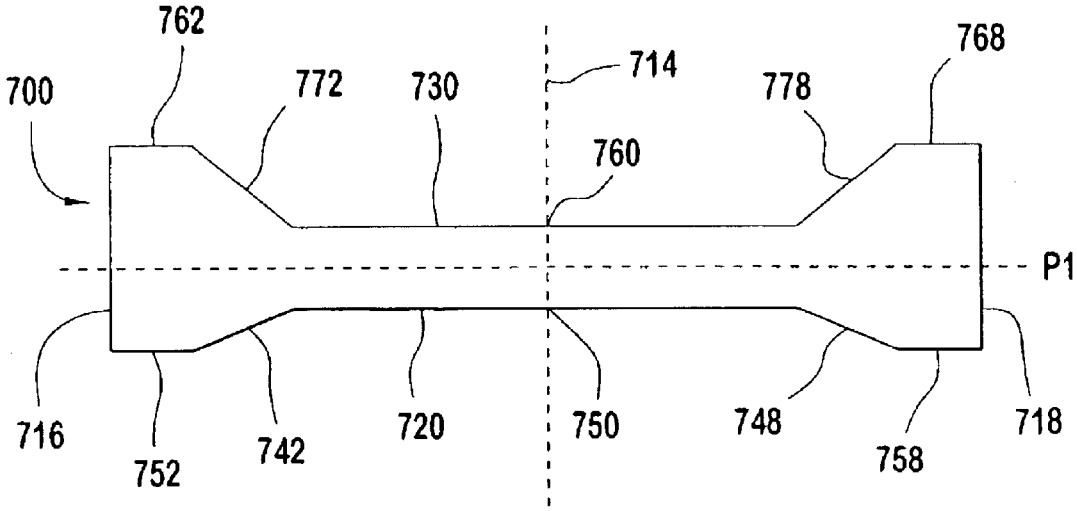
FIG. 12 is a top view of a first variation of the second embodiment of the back blocking device of the present invention.

A first variation of the second embodiment is shown in FIG. 12 and is identified as back blocking device 700. The back blocking device 700 has an elongated member 712 lying in a plane P1 and having a longitudinal axis 714, a first side 720, a second side 730, and first and second ends 716, 718, respectively. The back blocking device 700 has a length, thickness and width similar to that of the elongated member 612. In this variation, the first end 716 of the first side 720 of the elongated member 712 and the second end 718 of the first side 720 of the elongated member 712 are formed to have raised portions 752, 758 that extend away from the plane P1 toward the first side 720. The raised portions 752, 758 extend substantially the same distance from the plane P1 and are substantially perpendicular to the plane P1. Adjacent to the raised portions 752, 758 and toward the longitudinal axis 714 are angular portions 742, 748. The angular portions 742, 748 extend toward the plane P1. Moving from the angular portions 742, 748 toward the longitudinal axis 714, a substantially flat portion 750 that is substantially parallel to the plane P1 extends from the angular portion 742 through the longitudinal axis 712 and to the angular portion 748. The distance between the raised portions 752, 758 and the flat portion 750 at the longitudinal axis 714 is substantially the same as the distance C in the back blocking device 600 of the second embodiment. Similarly, the second side 730 has raised portions 762, 768 perpendicular to the plane P1 and toward the second side 730 at the first and second ends 716, 718, respectively. Adjacent to the raised portions 762, 768 are angular portions 772, 778 that extend toward the plane P1. Moving from the angular portions 772, 778 toward the longitudinal axis 714, a substantially flat portion 760 that is substantially parallel to the plane P1 extends from the angular portion 772 through the longitudinal axis 714 and to the angular portion 778. The distance between the raised portions 772, 768 and the flat portion 760 at the longitudinal axis 714 is substantially the same as the distance D in the back blocking device 600 of the second embodiment. Back blocking device 700 is installed and will function in a manner similar to that of the back blocking device 600 described above wherein both the first side 720 and the second side 730 accommodate different wallboard thicknesses to create a desired beveled effect.

Figure 13:
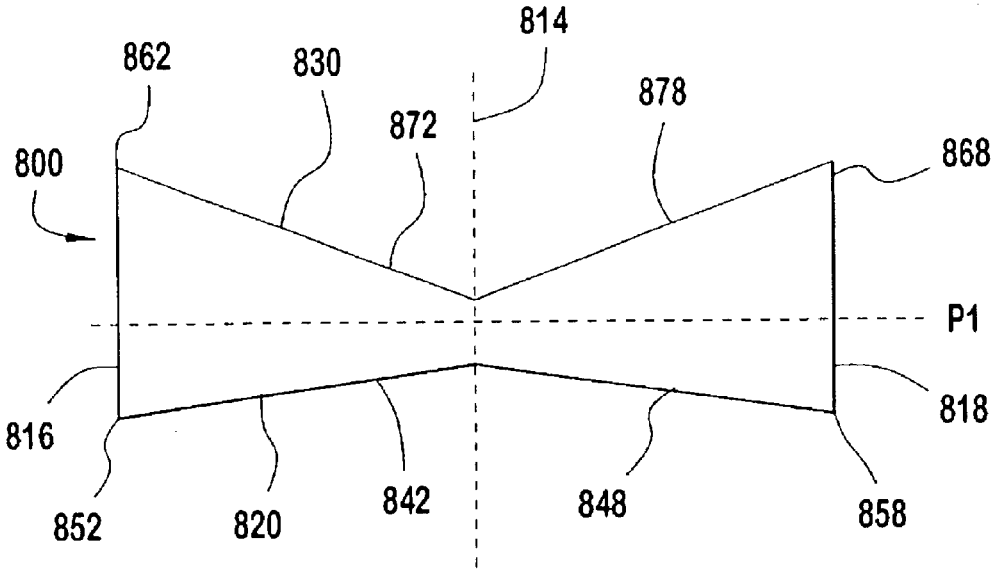
FIG. 13 is a top view of a second variation of the second embodiment of the back blocking device of the present invention.

A second variation of the second embodiment is shown in FIG. 13 and is identified as back blocking device 800. The back blocking device 800 has an elongated member 812 lying in a plane P1 and having a longitudinal axis 814, a first side 820, a second side 830, and first and second ends 816, 818, respectively. The back blocking device 800 has a length, thickness and width similar to that of the elongated member 612. In this variation, the first end 816 of the elongated member 812 and the second end 818 of the elongated member 812 are formed to have raised portions 852, 858 on the first side 820. Moving from the raised portions 852, 858 toward the longitudinal axis 814, the first side of the elongated member converges at the longitudinal axis 814 creating angular portions 842, 848. The distance between the raised portions 852, 858 and the first side 820 at the longitudinal axis 812 is substantially the same as the distance C in the back blocking device 600 of the second embodiment. The second side 830 is formed in substantially the same manner wherein the first and second ends 816, 818 form raised portions 862, 868, respectively. Moving from the raised portions 862, 868, toward the longitudinal axis, the second side 830 of the elongated member 812 converges at the longitudinal axis 814 creating angular portions 872, 878. The distance from the raised portions 862, 868 and the second side 830 at the longitudinal axis 814 is substantially the same as the distance D in the back blocking device 600 of the second embodiment. Back blocking device 800 is installed and will function in a manner similar to that of the back blocking device 600 described above wherein both the first side 820 and the second side 830 accommodate different wallboard thicknesses to create a desired beveled effect.

Figure 14:
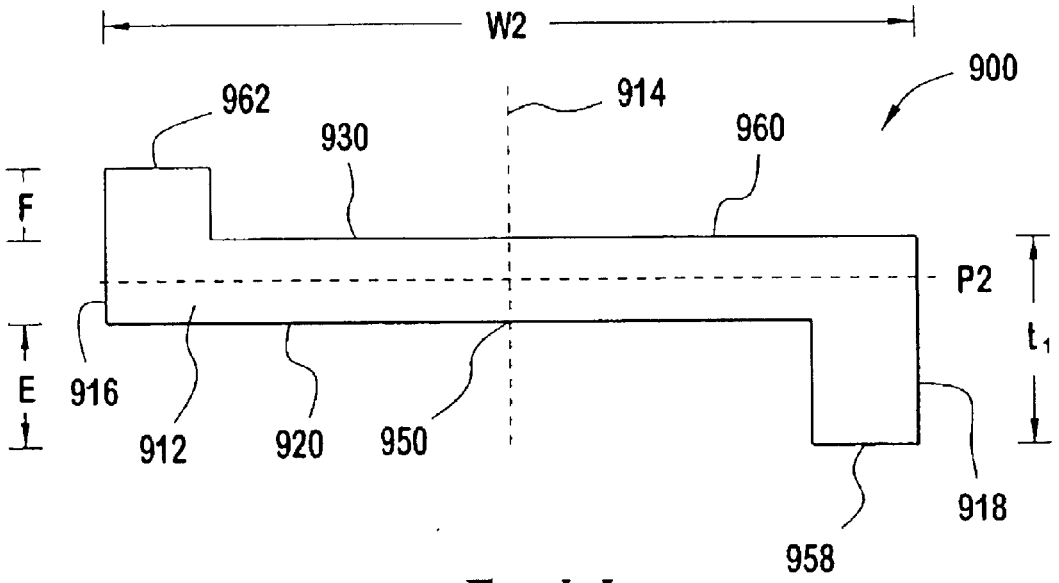
FIG. 14 is a top view of a third embodiment of the back blocking device of the present invention.

A third embodiment of the back blocking device 10 is shown in FIG. 14 and identified as back blocking device 900. The back blocking device 900 has several different characteristics than the first embodiment of the back blocking device 10, however, the third embodiment functions in a substantially similar manner and achieves substantially similar results as the first embodiment. The back blocking device 900 has an elongated member 912 lying in a plane P2 and having a longitudinal axis 914, a first side 920, a second side 930, and first and second ends 916, 918, respectively. The elongated member 912 is made of a material such as wood or plastic and has a width W2 of approximately 4 inches, a thickness t2 of approximately ¾ inches, and a length similar to the elongated member 12 of the first embodiment. The elongated member 912 is molded or extruded to have a plurality of raised portions 962, 958 that function in a substantially similar manner as the raised portions of the first embodiment. A plurality of apertures (not shown) span the length of the elongated member 912 and are positioned adjacent to the longitudinal axis 914 on the first and second sides 920, 930 for attachment of first and second pieces of wallboard (not shown). The apertures (not shown) function in a substantially similar manner as the apertures 40 of the first embodiment 10.

The elongated member 912 will now be described in greater detail. The first side 920 of the elongated member 912 has a first raised portion 958 at the second end 918. The first raised portion 958 extends away from the plane P2 toward the first side 920 and is substantially perpendicular to the plane P2. Moving from the first raised portion 958 toward the first end 916 of the first side 920 of the elongated member 912, the elongated member has a substantially flat portion 950 that extends from the first raised portion 958 through the longitudinal axis 914 and to the first end 916. The distance E from the raised portion 958 to the first side 920 at the longitudinal axis 914 is approximately 1/16 of an inch. It will be appreciated by one skilled in the art, however, that by varying the height and/or location of the first raised portion 958 the distance E may be increased or decreased accordingly. It will also be appreciated by one skilled in the art that the distance E could also be accomplished by changing the location of the first raised portion 958.

The second side 930 of the elongated member 912 has a second raised portion 962 at the first end 916. The second raised portion 962 extends away from the plane P2 toward the second side 930 and substantially perpendicular to the plane P2. Moving from the second raised portion 962 toward the second end 918 of the second side 930 of the elongated member 912, the elongated member 912 has a substantially flat surface 960 that extends from the second raised portion 962 through the longitudinal axis 914 and to the second end 918. The distance F from the second raised portion 962 to the second side 930 at the longitudinal axis 914 is approximately 3/16 of an inch. It will be appreciated by one skilled in the art, however, that by varying the height and/or location of the second raised portion 962 the distance F may be increased or decreased accordingly. It will also be appreciated by one skilled in the art that the distance F could also be accomplished by changing the location of the second raised portion 962.

The back blocking device 900 is installed and will function in a manner similar to that of the back blocking device 10 of the first embodiment described above wherein both the first side 920 and the second side 930 accommodate different wallboard thicknesses to create a desired beveled effect.

One skilled in the art may appreciate that the back blocking device 900 of the present invention may be altered geometrically to obtain the same results. By altering the configuration of the elongated member 912, the back blocking device 900 may still have the same or equivalent properties as the third embodiment. A variation of the back blocking device 900 of the present invention will be discussed below.

Figure 15:
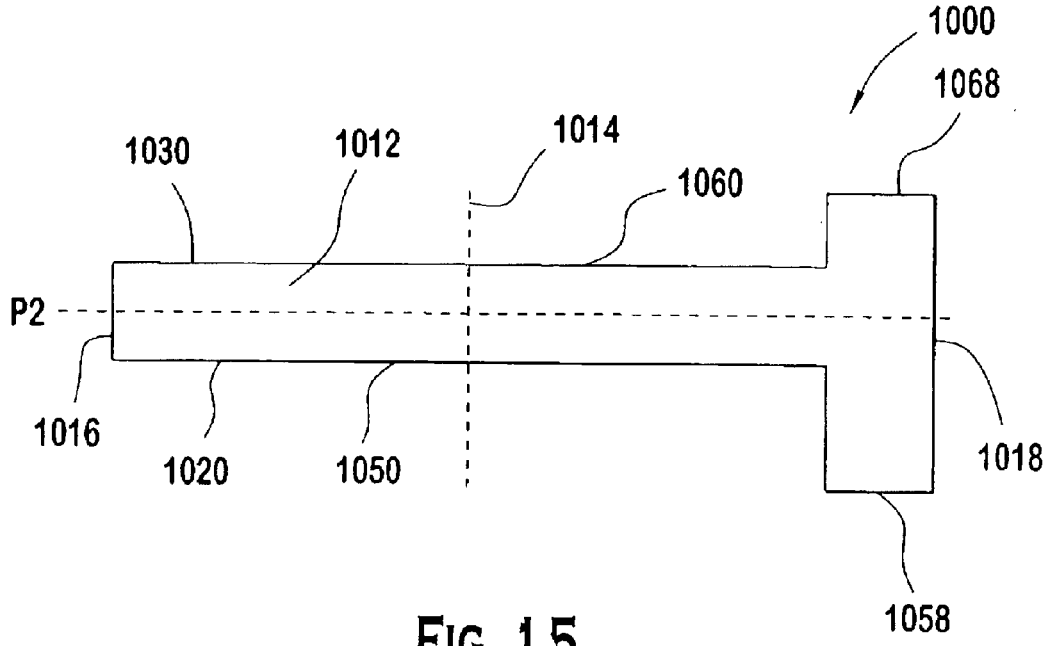
FIG. 15 is a top view of a first variation of the third embodiment of the back blocking device of the present invention.

A first variation of the back blocking device 900 is shown in FIG. 15 and is identified as back blocking device 1000. The back blocking device 1000 has an elongated member 1012 lying in a plane P2 and having a longitudinal axis 1014, a first side 1020, a second side 1030, and first and second ends 1016, 1018, respectively. The back blocking device 1000 has a length, thickness, and width similar to that of the elongated member 912. In this variation, the first side 1020 is similar to the first side 920 of the elongated member 912 wherein the first side 1020 of the elongated member 1012 has a first raised portion 1058 positioned at the second end 1018 that extends away from and substantially perpendicular to the plane P2 and toward the first side 1020. The elongated member 1012 has a substantially flat surface 1050 that extends from the first raised portion 1058 through the longitudinal axis 1014 and to the first end 1016. The distance from the first raised portion 1058 to the first side 1020 at the longitudinal axis 1014 is substantially the same as the distance E in the back blocking device 900 of the third embodiment. The second side 1030 has a second raised portion 1068 positioned at the second end 1018 that extends away from and substantially perpendicular to the plane P2 and toward the second side 1030. The elongated member 1012 has a substantially flat surface 1060 that extends from the second raised portion 1068 through the longitudinal axis 1014 and to the first end 1016. The distance from the second raised portion 1068 to the second side 1030 at the longitudinal axis 1014 is substantially the same as the distance F in the back blocking device 900 of the third embodiment. The back blocking device 1000 is installed and will function in a manner similar to back blocking device 900 described above wherein both the first side 1020 and the second side 1030 accommodate different wallboard thicknesses to create a desired beveled effect.

Figure 16:
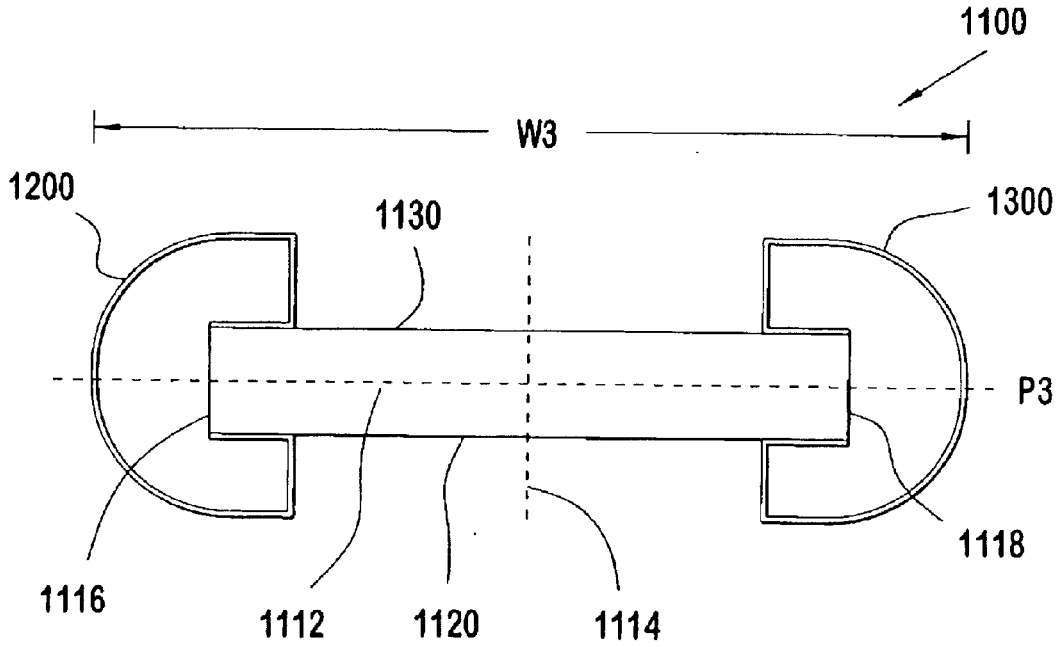
FIG. 16 is a top view of a fourth embodiment of the back blocking device of the present invention.

A fourth embodiment of the back blocking device 10 is shown in FIG. 16 and identified as back blocking device 1100. The fourth embodiment has several different characteristics than the first embodiment, however the fourth embodiment functions in a substantially similar manner and achieves substantially similar results as the first embodiment. The back blocking device 1100 comprises first and second clips 1200, 1300 and an elongated member 1112. The elongated member 1112 lies in a plane P3 and has a first side 1120, a second side 1130, and first and second ends 1116, 1118, respectively. The elongated member 1112 is made of a thin material such as paperboard, fiberboard, or hardboard and has a length similar to the length of the elongated member 12 of the first embodiment. A plurality of apertures (not shown) span the length of the elongated member 1112 and are positioned adjacent to the longitudinal axis 1114 on the first and second sides 1120, 1130 for attachment of first and second pieces of wallboard (not shown). The apertures (not shown) function in a substantially similar manner as the apertures 40 of the first embodiment.

Figure 17:
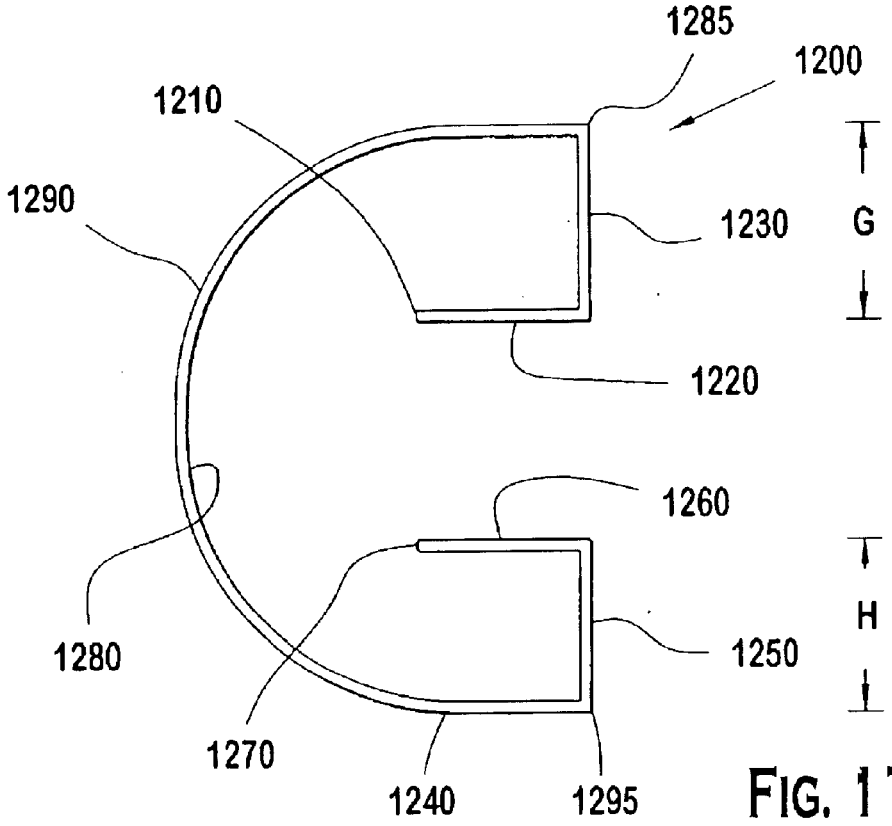
FIG. 17 is a top view of a first clip of the fourth embodiment of the back blocking device of the present invention.

Shown in FIGS. 16 and 17, the first and second clips 1200, 1300 will now be described in greater detail. Because the first and second clips 1200, 1300 are preferably symmetrical in configuration, while the clip 1200 will be described in greater detail below, it will be appreciated by one skilled in the art that the second clip 1300 is formed and will function in a substantially similar manner. The first clip 1200 is formed from a resilient metal strip or any other suitably resilient material. The first clip 1200 is formed to have a first edge 1210, a second edge 1270, and inner and outer surfaces 1280, 1290, respectively. Starting at the first edge 1210 and moving toward the second edge 1270, the first clip 1200 is formed to have a first portion 1220. The first clip 1200 is then formed to have a second portion 1230 substantially perpendicular to the first portion 1220. The first clip 1200 is then formed to have a third portion 1240 adjacent to the second portion 1230 and substantially semi-circular in shape. A fourth portion 1250 is substantially perpendicular to the third portion 1240. The first clip 1200 is then formed to have a fifth portion 1260 perpendicular to the fourth portion 1250 and substantially parallel to the first portion 1220. The fifth portion 1260 terminates at the second edge 1270.

The second portion 1230 of the first clip 1200 has a distance G that is approximately 1/16 of an inch. The fourth portion 1250 of the first clip 1200 has a distance H that is approximately 3/16 of an inch. It will be appreciated by one skilled in the art that by varying the dimensions of the first, second, third, fourth and/or fifth portions 1220, 1230, 1240, 1250, 1260 of the first clip 1200 that the distance G and the distance H may be increased or deceased accordingly. It will also be appreciated by one skilled in the art that the distances G and H may be accomplished by altering the geometrical configuration of the first clip 1200.

The attachment of the first clip 1200 to the elongated member 1112 will now be described in greater detail. As shown in FIG. 16, the first clip 1200 is attached to the first end 1116 of the elongated member 1112 by positioning the first end 1116 adjacent to the outer surface 1290 of the first portion 1220 and the fifth portion 1260. The first end 1116 of the elongated member 1112 is received between the outer surface 1290 of the first portion 1220 and the fifth portion 1260, the first side 1120 positioned adjacent to the fifth portion 1260 and the second side 1130 positioned adjacent to the first portion 1220, until the first end 1116 is substantially parallel to the first and second edges 1270, 1210. The resiliency of the first clip 1200 enables the first and fifth portions 1220, 1260 to act akin to Chinese fingers, enabling the the outer surface 1290 of the first and second portions 1220, 1260 to grasp the respective first side 1120 and second side 1130 of the elongated member 1112 to prevent unwanted removal of the first clip 1200 from the elongated member 1112. The second clip 1300 is then attached to the second end 1118 of the elongated member 1112. It will be appreciated and understood by one skilled in the art that the attachment of the second clip 1300 to the second end 1118 of the elongated member 1112 can be accomplished in substantially the same manner as the attachment of the first clip 1200 to the first end 1116 of the elongated member 1112 to obtain substantially the same result.

The back blocking device 1100 is installed and will function in a manner similar to that of the back blocking device 10 of the first embodiment described above wherein both the first side 1020 and the second side 1030 accommodate different wallboard thicknesses to create a desired beveled effect. It will be appreciated by one skilled in the art, however, that while the first and second clips 1200, 1300 are described herein as having a length substantially the same as the length of the elongated member 1112 for stability, the clips can be a plurality of smaller clips attached spatially along the length of the first and second ends 1116, 1118 of the elongated member 1112 to achieve a substantially similar result. It will also be appreciated by one skilled in the art that while the first and second clips 1200, 1300 are described as having outer and inner surfaces 1280, 1290, the first and second clips 1200, 1300 could be configured by extruding a solid material such as plastic.

Figure 18:
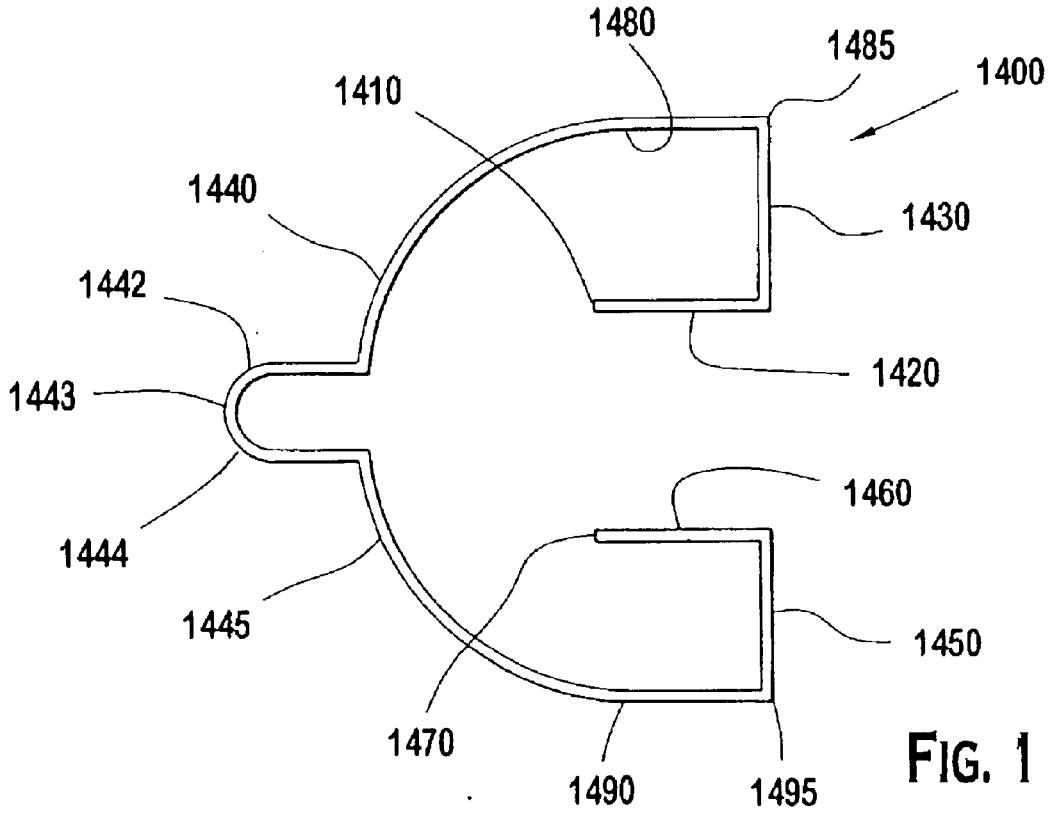
FIG. 18 is a first variation of the first clip of the fourth embodiment of the back blocking device of the present invention.

A first variation of the first and second clips 1200, 1300 is shown in FIG. 18 and is identified as third clip 1400. While the third clip 1400 will be described in greater detail below, it will be appreciated by one skilled in the art that the third clip 1400 will function in a manner similar to the first and second clips 1200, 1300 when attached to the elongated member 1112. The third clip 1400 is formed from substantially the same material and has substantially the same length as t he first clip 1200. The third clip 1400 is formed to have a first edge 1410, a second edge 1470, and inner and outer surfaces 1480, 1490, respectively. Starting at the first edge 1410 and moving toward the second edge 1470, the first clip 1400 is formed to have a first portion 1420. The third clip 1400 is then formed to have a second portion 1430 substantially perpendicular to the first portion 1420. The third clip 1400 is then formed to have a third portion 1440 adjacent to the second portion 1430 and substantially curved in shape. Adjacent to the third portion 1440 is a projecting portion 1443. The projecting portion 1443 projects away from the outer surface 1490 and is substantially semicircular in shape. The projecting portion 1443 has a top portion 1442 and a bottom portion 1444. The top portion 1442 is positioned substantially parallel to the first portion 1420, and the bottom portion 1444 is positioned substantially parallel to a sixth portion 1460. Adjacent to the projecting portion 1443 is a fourth portion 1445. The fourth portion 1445 is substantially curved in shape. A fifth portion 1450 is substantially perpendicular to the fourth portion 1445. The third clip 1400 is then formed to have the sixth portion 1460 perpendicular to the fifth portion 1450 and substantially parallel to the first portion 1420. The sixth portion 1460 terminates at the second edge 1470. The second portion 1430 of the third clip 1400 has a distance similar to the distance G of the first clip 1200. The fifth portion 1450 of the third clip 1400 has a distance similar to the distance H of the first clip 1200.

The third clip 1400 will be attached to the elongated member 1112 in a substantially similar manner as the first and second clips 1200, 1300. In this instance, however, after the first end 1116 of the elongated member 1112 is received between the outer surface 1490 of the first portion 1420 and the sixth portion 1460, the first side 1420 is positioned adjacent to the sixth portion 1460 and the second side 1130 is positioned adjacent to the first portion 1220, until the first end 1116 is received between the inner surface 1480 of the top portion 1442 and the inner surface 1480 of the bottom portion 1444 of the projecting portion 1443. Resultantly, the resiliency of the third clip 1400 enables the first and sixth portions 1420, 1460 to act akin to Chinese fingers, enabling the outer surface 1490 of the first and sixth portions 1420, 1460 to grasp the respective first side 1120 and second side 1130 of the elongated member 1112 to prevent unwanted removal of the third clip 1400 from the elongated member 1112. The projecting portion 1443 further prevents unwanted removal and/or twisting of the third clip 1400 by the resilient force of the inner surface 1480 of the projecting portion 1443 acting on the elongated member 1112. A fourth clip (not shown), substantially similar to the third clip 1400, is then attached to the second end 1118 of the elongated member 1112. The third clip 1400 and the fourth clip (not shown), therefore, will function in a manner similar to the first and second clips 1200, 1300 described above wherein the third clip 1400 and the fourth clip (not shown) will accommodate different wallboard thicknesses to create a desired beveled effect.

The foregoing illustrates some of the possibilities for practicing the invention. It will be appreciated and understood by one skilled in the art that the distance of the raised portions in the foregoing embodiments are illustrative and that depending on the rigidity of the material used for the elongated member may vary in distance to obtain the desired result. Many other embodiments are also possible within the scope and spirit of the invention. It is, therefore, intended that the foregoing description be regarded as illustrative rather than limiting, and that the scope of the invention is given by the appended claims together with their full range of equivalents.

What is claimed is:

1. A device that connects adjacent ends of a first piece of wallboard and a second piece of wallboard forming a butt joint therebetween, comprising:

first and second pieces of wallboard;

an elongated member having a longitudinal axis, a first side configured to receive the first and second pieces of wallboard and a second side reverse to the first side configured to receive the first and second pieces of wallboard when assembled in an alternate state;

the first side having a first offset of a first distance;

the second side having a second offset opposed to the first offset of a second distance, the second distance being different than the first distance; and wherein the first piece of wallboard and the second piece of wallboard are secured to either the first side or the second side while lying essentially within a common plane.

2. The device of claim 1, wherein the elongated member has a plurality of apertures positioned adjacent to the longitudinal axis on the first side and the second side for receipt of means for fastening the first piece of wallboard and the second piece of wallboard to the elongated member.

3. The device of claim 1, wherein the elongated member has a first end and a second end, the first end forming the first offset and the second end forming the second offset.

4. The device of claim 1, wherein the elongated member has a central recessed portion at the longitudinal axis.

5. The device of claim 1, wherein the elongated member has a substantially flat portion at the longitudinal axis.

6. A device that connects adjacent ends of a first piece of wallboard and a second piece of wallboard forming a butt joint therebetween, comprising:

first and second pieces of wallboard;

an elongated member having a longitudinal axis, a first side configured for attaching the first and second pieces of wallboard and a second side reverse to the first side configured for attaching the first and the second piece of wallboard when assembled in an alternate state;

the first side of the elongated member having a first outer surface and a second outer surface having substantially the same configuration and converging at the longitudinal axis; the first outer surface having a first raised portion a first distance from the first side;

the second side of the elongated member having a first inner surface and a second inner surface having substantially the same configuration and converging at the longitudinal axis, the first inner surface having a second raised portion a second distance from the second side, the second distance being different from the first distance; and wherein the first piece of wallboard and the second piece of wallboard are secured to either the first side or the second side while lying essentially within a common plane and are converged for attachment to the elongated member substantially near the longitudinal axis.

7. The device of claim 6, wherein the first distance is approximately 3/16 of an inch.

8. The device of claim 6, wherein the second distance is approximately 1/16 of an inch.

9. The device of claim 6, wherein the elongated member has a plurality of apertures positioned adjacent to the longitudinal axis on the first side and the second side for receipt of means for fastening the first piece of wallboard and the second piece of wallboard to the elongated member.

10. The device of claim 6, wherein the elongated member has a first end forming the first raised portion and the second raised portion.

11. The device of claim 6, wherein the elongated member has a central recessed portion at the longitudinal axis.

12. The device of claim 6, wherein the elongated member has a substantially flat portion at the longitudinal axis.

13. A device that connects adjacent ends of a first piece of wallboard and a second piece of wallboard forming a butt joint therebetween, comprising:

first and second pieces of wallboard;

an elongated member having a longitudinal axis, a first side configured for attaching the first and second piece of wallboard and a second side reverse to the first side configured for attaching the first and the second piece of when assembled in an alternate state;

the first side of the elongated member having a first outer surface and a second outer surface having substantially the same configuration and converging at the longitudinal axis;

the first outer surface having a first raised portion a first distance from the first side of the elongated member at the longitudinal axis and a first recessed portion;

the second side of the elongated member having a first inner surface and a second inner surface having substantially the same configuration and converging at the longitudinal axis, the first inner surface having a second raised portion a second distance from the second side of the elongated member at the longitudinal axis and positioned inverse to the first recessed portion and a second recessed portion positioned inverse to the first raised portion, the first distance being different from the second distance; and wherein the first piece of wallboard and the second piece of wallboard are secured to either the first side or the second side while lying essentially within a common plane and are converged for attachment to the elongated member substantially near the longitudinal axis.

14. The device of claim 13, wherein the first distance is approximately 3/16 of an inch.

15. The device of claim 13, wherein the second distance is approximately 1/16 of an inch.

16. The device of claim 13, wherein the elongated member has a plurality of apertures positioned adjacent to the longitudinal axis on the first side and the second side for receipt of means for fastening the first and second pieces of wallboard to the elongated member.

17. The device of claim 13, wherein the elongated member has a first end forming the first raised portion.

18. The device of claim 13, wherein the elongated member has a central recessed portion at the longitudinal axis.

19. The device of claim 13, wherein the elongated member has a substantially flat portion at the longitudinal axis.

20. The device of claim 13, wherein the elongated member has a central raised portion at the longitudinal axis.

* * * * *

UNITED STATES PATENT AND TRADEMARK OFFICE

CERTIFICATE OF CORRECTION

PATENT NO. : 6,807,781 B2
DATED : October 26, 2004
INVENTOR(S) : Darrick S. Trout It is certified that error appears in the above-identified patent and that said Letters Patent is hereby corrected as shown below:

Title page,
Item [57], ABSTRACT,
Line 1, change "comprising" to -- comprises --.

Column 16,
Line 48, change "the first and the second piece" to -- the first and second pieces --.

Column 17,
Line 22, change "the first and second piece" to -- the first and second pieces --.
Line 24, change "the first and the second piece" to -- the first and second pieces --.
Line 25, change "of when assembled" should read -- of wallboard when assembled --.

Signed and Sealed this

Twenty-ninth Day of March, 2005

JON W. DUDAS
*Director of the United States Patent and Trademark Office*